United States Patent [19]

Peppiatt et al.

[11] Patent Number: 4,815,590

[45] **Date of Patent: * Mar. 28, 1989**

[54] BAG WITH ABSORBENT INSERT

[75] Inventors: Harry R. Peppiatt, Doylestown; John S. Thomas, Langhorne, both of Pa.

[73] Assignee: Paramount Packaging Corporation, Chalfont, Pa.

[ * ] Notice: The portion of the term of this patent subsequent to Oct. 28, 2003 has been disclaimed.

[21] Appl. No.: 117,354

[22] Filed: Oct. 27, 1987

Related U.S. Application Data

[63] Continuation of Ser. No. 499,586, May 31, 1983, abandoned.

[51] Int. Cl.[4] ..... B65D 81/26; B65D 81/22

[52] U.S. Cl. ..... 206/204; 206/205; 383/119; 426/124

[58] Field of Search ..... 206/460, 813, 204, 205, 206/554; 383/120, 123, 124; 426/124

[56] References Cited

U.S. PATENT DOCUMENTS

| | | | |
|---|---|---|---|
| 3,256,941 | 6/1966 | Rirman | 206/632 |
| 3,372,857 | 3/1968 | Brayla | 206/554 |
| 3,804,322 | 4/1974 | Ericson | 206/554 |
| 3,915,302 | 10/1975 | Farrelly | 206/554 |
| 4,401,213 | 8/1983 | Lerner | 206/806 |
| 4,410,578 | 10/1983 | Miller | 206/204 |
| 4,619,361 | 10/1986 | Thomas, Jr. | 206/205 X |

FOREIGN PATENT DOCUMENTS

| | | | |
|---|---|---|---|
| 2314871 | 1/1977 | France | 206/554 |
| 1136405 | 12/1968 | United Kingdom | 383/120 |
| 1552810 | 9/1979 | United Kingdom | 206/204 |

*Primary Examiner*—Stephen Marcus

*Attorney, Agent, or Firm*—Panitch Schwarze Jacobs & Nadel

[57] ABSTRACT

A plastic bag for packaging articles including fresh meats and the like has an absorbent insert attached to the interior surface of the rear panel of the bag. The insert is generally rectangular and is attached to the rear panel along the side closest to the bag opening so that the insert cannot be dislodged when the bag is filled. The insert absorbs blood and other fluids in the meats to keep the package neat and clean and minimize the danger of leakage.

10 Claims, 2 Drawing Sheets

FIG. 1
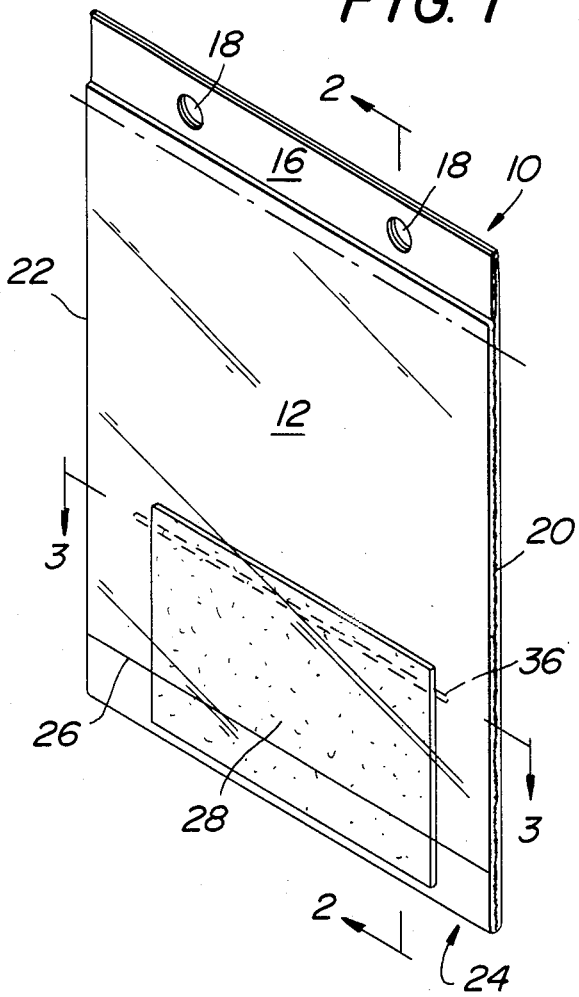
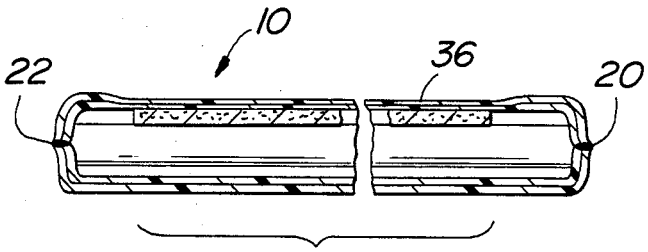
FIG. 3
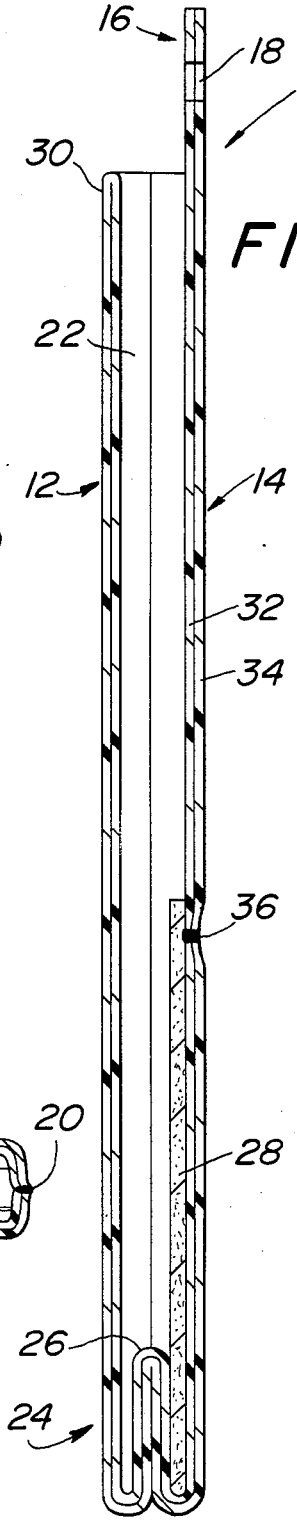
FIG. 2

BAG WITH ABSORBENT INSERT

This is a continuation of co-pending application Ser. No. 499,586 filed on May 31, 1983 now abandoned.

BACKGROUND OF THE INVENTION

This invention relates to a bag for packaging articles, and, in particular, fresh meats and poultry.

Fresh meats and poultry are often sold packaged in transparent plastic bags. Consumers are able to readily view the contents of the bag and make their selection based upon the appearance of the contents.

A problem with this type of packaging is that poultry and other meats, no matter how carefully prepared, contain residual blood and other fluids which flow out of the meat after it has been packaged. The blood and other fluids accumulate in the package, thereby detracting from its appearance. In addition, the blood and fluid sometimes leak from the package while the consumer is transporting it home from the market.

It is an object of the present invention to provide a package for articles such as poultry, meats and the like which will absorb blood and other fluids and present a neat and attractive appearance to the consumer and will avoid the danger of leakage.

SUMMARY OF THE INVENTION

The present invention is a bag comprising generally rectangular front and rear panels overlying one another and a gusset integral with the panels and extending between side edges of the panels along one end of the panels. The gusset has a fold line located between the panels which defines the inner boundary portion of the gusset. Each panel has a fold line at said one end which defines the outer boundary portions of the gusset. The side edges of the panels are connected together. The other end of the panels is open to facilitate introducing goods into the bag. A pad of absorbent material is attached to the interior surface of the rear panel.

In the preferred embodiment of the invention, the pad is generally rectangular and is attached to the interior surface of the rear panel along an edge of the pad closest to the open end of the bag so that the goods may be inserted into the bag without dislodging the pad.

In another embodiment of the invention, the pad comprises a non-woven absorbent material within a sleeve of perforated thermoplastic material.

For the purpose of illustrating the invention, there is shown in the drawings a form which is presently preferred; it being understood, however, that this invention is not limited to the precise arrangements and instrumentalities shown.

DESCRIPTION OF THE DRAWINGS

FIG. 1 is a perspective view showing a bag in accordance with the present invention.

FIG. 2 is a cross-sectional view of the bag of FIG. 1 taken along the lines 2—2 in FIG. 1.

FIG. 3 is a sectional view of the bag of FIG. 1 taken along the line 3—3 in FIG. 1.

DETAILED DESCRIPTION

Figure 4:
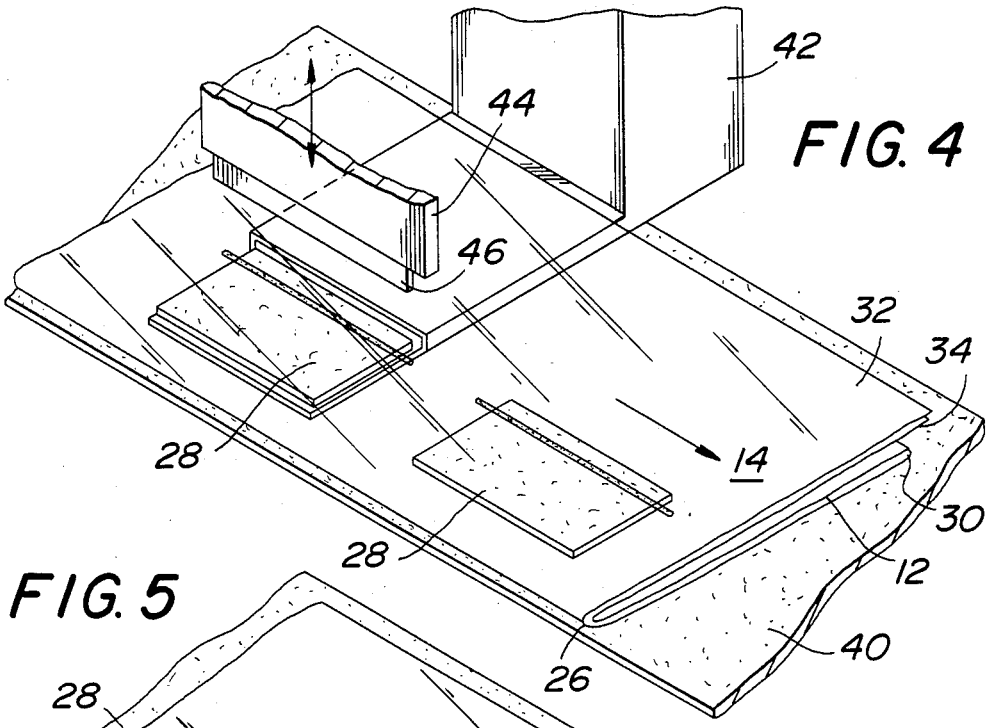
FIG. 4 illustrates the attachment of the absorbent pad to the web of thermoplastic material from which the bag of FIG. 1 is formed.

Referring to the drawings, wherein like numerals indicate like elements, there is shown in FIGS. 1–3 a bag in accordance with the present invention. The bag consists of a front wall 12 and a back wall 14 which are integrally joined at one end by gusset 24. Gusset 24 has a fold line 26 which extends for the width of front and rear panels 12 and 14, respectively, and forms the bottom of bag 10. Front panel 12 and rear panel 14 are joined together along seams 20 and 22 along their side edges. The ends of front and rear panels 12 and 14 furthest from gusset 24 are open to facilitate the insertion of goods into the bag. The length of rear panel 14 is greater than the length of front panel 12 to provide a lip 16 along the top portion of rear panel 14. Lip 16 is useful in grasping the bag and opening the bag prior to inserting goods therein. Lip 16 may be provided with wicket holes 18. Wicket holes 18 may be used to facilitate locating stacks of individual bags on posts passing through the wicket holes. Individual bags may then be readily torn off for use while the remainder of the bags stays neatly stacked.

In the illustrated embodiment, bag 10 contains an absorbent insert, or pad, 28 which is generally rectangular. Insert 28 preferably consists of a pad of non-woven absorbent material encased in a sleeve of perforated thermoplastic material. The perforations in the sleeve permit the fluids from the contents of the bag to be absorbed into the non-woven pad. The thermoplastic material of the sleeve allows the insert 28 to be attached to the interior surface of rear wall 14 by a bar weld 36. Bar weld 36 preferably extends for at least the full length of insert 28 and for short distance on either side of insert 28.

As best seen in FIG. 2, bag 10 is formed of two layers 32 and 34 of thermoplastic material. Layers 32 and 34 are obtained by folding a single ply of thermoplastic material along fold line 30 at the top edge of front panel 12. The double layer construction gives the bag 10 added strength.

Figure 5:
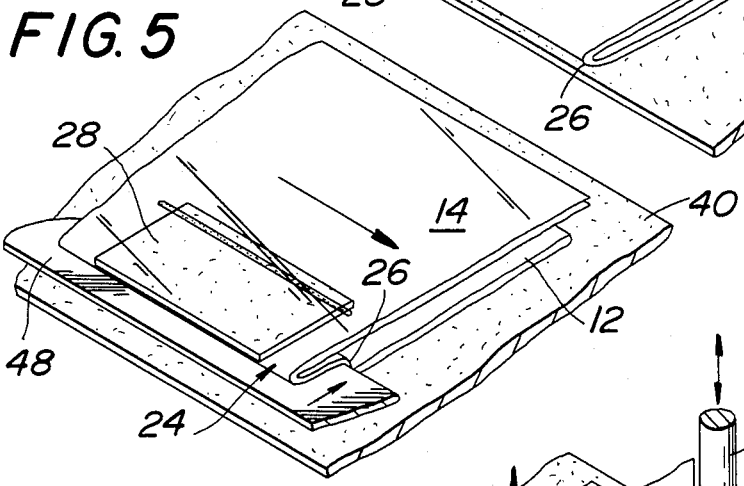
FIG. 5 illustrates the formation of the gusset.
Figure 6:
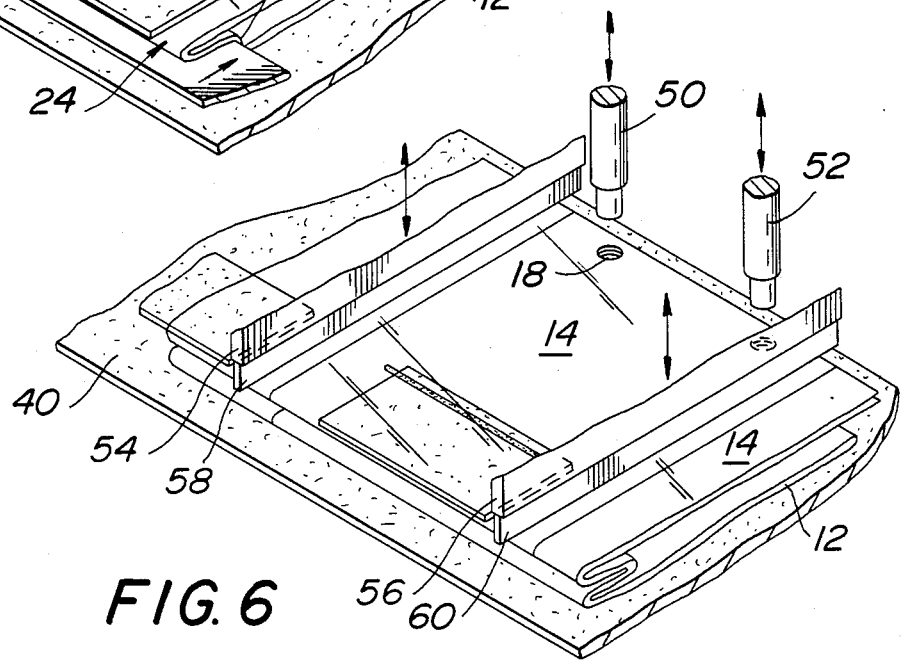
FIG. 6 illustrates the sealing of the sides and the severing of the web to form individual bags.

Fabrication of the bag is illustrated in FIGS. 4–6. In FIG. 4, a folded web of thermoplastic material is moved by conveyor 40 past a bar welding station where insert 28 is attached to the portion of the web which will become the rear panel of the bag. As shown in FIG. 4, a single ply of thermoplastic material has been folded in half along fold line 30 and then back on itself along fold line 26. An anvil 42 extends between the portion of the web which will become rear panel 14 and the portion which will become front panel 12. Anvil 42 carries absorbent inserts 28 to be bar welded to the web. A sealing head 44 having a heated bar 46 moves reciprocally up and down as indicated by the arrows in FIG. 4. The web of thermoplastic material moves to the lower right in FIG. 4 as shown by the arrows.

The web of thermoplastic material may be moved by conveyor 40 past the welding station in a known manner. Thus, conveyor 40 may be indexed past the sealing station for a distance corresponding to the width of the bag to be made. Each time the conveyor moves the appropriate distance, an insert 28 may be fed onto anvil 42. After an insert is in place, sealing head 44 moves downward and seals insert 28 to the web by means of heated bar 46.

After the insert is welded in place, the web with the attached insert proceeds to a folding station where gusset 24 is formed. A flat bar 48 is placed against fold line 26 and moved to the upper right, as shown by the arrow in FIG. 5, to form gusset 24.

After the gusset 24 is formed, the web then moves to the final station where the side edges are sealed and the wicket holes are punched. Side seams 20 and 22 are formed by sealing heads 54 and 56, which carry heated bars 58 and 60, respectively. Sealing heads 54 and 56 move reciprocally up and down as indicated by the arrows in FIG. 6. When the web is in proper position, sealing heads 54 and 56 move downward and seal all of the layers of the web together to form side seams 20 and 22. Simultaneously, rods 50 and 52, which also move reciprocally up and down, move downward to punch wicket holes 18. The web is then moved to a cutting station where individual bags are severed from the web in known manner.

It will be appreciated that the bag of the present invention provides an improved package for articles, and, in particular, poultry, meats and the like. The absorbent insert collects blood and other fluids so that the package presents a neat and clean appearance to the consumer.

The present invention may be embodied in other specific forms without departing from the spirit or essential attributes thereof and, accordingly, reference should be made to the appended claims, rather than to the foregoing specification, as indicating the scope of the invention.

We claim:

1. A bag comprising generally rectangular front and rear panels overlying one another, a gusset integral with said panels and extending between the side edges of said panels along one end of said panels, said gusset having a fold line located between said panels and defining the inner boundary portion of said gusset, each panel having a fold line at one end defining the outer boundary portions of said gusset, the other end of said panels being open to facilitate introducing meats and the like into the bag, the side edges of said panels being connected together, and a pad of adsorbent material welded to the interior surface of the rear panel at a location where at least a portion of said pad is immediately adjacent to said gusset.

2. A bag as in claim 1, wherein the bag material is a transparent, flexible thermoplastic.

3. A bag as in claim 2, wherein said pad is generally rectangular and is attached to the interior surface of said rear panel along an edge of said pad closest to the open end of said bag to facilitate the introduction of goods into the bag without dislodging the pad.

4. A bag as in claim 3, wherein said pad comprises a non-woven absorbent material within a sleeve of perforated thermoplastic material.

5. A bag as in claim 4, wherein said pad is attached to the interior surface of said rear panel by hot welding of the thermoplastic material of said rear panel to the thermoplastic material of said sleeve.

6. A bag as in claim 1, wherein the length of said rear panel is greater than the length of said front panel so as to extend beyond said front panel at the open end of the bag to form a lip.

7. A bag as in claim 2, wherein said front and rear panels and said gusset comprise a double thickness of thermoplastic material.

8. A plastic bag for packaging meats and the like, comprising generally rectangular front and rear panels overlying one another, a gusset integral with said panels and extending between the side edges of said panels along one end of said panels, said gusset having a fold line located between said panels and defining the inner boundary portion of said gusset, each panel having a fold line at said one end defining the outer boundary portions of said gusset, the other end of said panels being open to facilitate introducing meats and the like into the bag, said panels being formed of two layers of material integrally joined along a fold line between the side edges of said front panel along said other end of said front panel, the side edges of said panels being connected together, the length of the rear panel being greater than the length of the front panel so as to extend beyond the front panel at the open end of the bag to form a lip, the lip being provided with one or more openings to facilitate locating stacks of bags on posts passing through the openings, and a generally rectangular pad of absorbent material welded to the interior surface of said rear panel along an edge of said pad closest to the open end of said bag to enable said meats and the like to be inserted into the bag without dislodging the pad, said pad welded to said interior surface at a location where at least a portion of said pad is immediately adjacent said gusset.

9. A bag as in claim 8, wherein said pad comprises a non-woven absorbent material within a sleeve of perforated thermoplastic material and is attached to the interior surface of said rear panel by hot welding of the plastic material of said rear panel to the thermoplastic material of said sleeve.

10. A bag comprising generally rectangular front and rear panels overlying one another, a folded section integral with said panels and extending between the side edges of said panels along one end of said panels, the other end of said panels being open to facilitate introducing meats and the like into the bag, the side edges of the panels being connected together, and a pad of absorbent material welded to the interior surface of said bag and located such that at least a portion of said pad is immediately adjacent said folded section.

* * * * *